US005485714A

United States Patent [19]

Montalvo

[11] Patent Number: 5,485,714

[45] Date of Patent: Jan. 23, 1996

[54] DISK LOADER HAVING A SIDE AIR BLAST FOR PROPER BAG PRESENTATION

[76] Inventor: Samuel A. Montalvo, 18750 Barnhart Ave., Cupertino, Calif. 95014

[21] Appl. No.: 395,056

[22] Filed: Feb. 27, 1995

[51] Int. Cl.[6] ..... B65B 43/36; B65B 43/26; B65B 61/00

[52] U.S. Cl. ..... 53/459; 53/141; 53/385.1; 53/572; 141/114

[58] Field of Search ..... 53/459, 385.1, 53/141, 570, 572, 386.1; 141/10, 114

[56] References Cited

U.S. PATENT DOCUMENTS

| | | | |
|---|---|---|---|
| 2,907,160 | 10/1959 | Friedman et al. | 53/385.1 X |
| 3,206,913 | 9/1965 | Fleigher et al. | 53/572 |
| 3,468,102 | 9/1969 | Farrar et al. | 53/385.1 |
| 3,527,021 | 9/1970 | Pitts, Jr. et al. | 53/385.1 |
| 3,753,331 | 8/1973 | Sato | 53/385.1 X |
| 3,807,123 | 4/1974 | Kihnke | 53/385.1 X |
| 3,948,015 | 4/1976 | Lerner | 53/385.1 X |
| 4,149,356 | 4/1979 | Palmer | 53/385.1 X |
| 4,567,715 | 2/1986 | Sawa et al. | 53/385.1 X |
| 5,199,246 | 4/1993 | Rodrigo | 53/141 X |
| 5,370,495 | 12/1994 | Montalvo et al. | 414/797.9 |

*Primary Examiner*—Horace M. Culver
*Attorney, Agent, or Firm*—Schneck & McHugh

[57] ABSTRACT

A method of loading disks includes first and second air-jet nozzles and a continuous flow of air. The first air jet nozzle is directed into the opening of the flexible bag to initiate opening the bag at a localized region. The continuous flow is designed to fully open the bag by taking advantage of the localized opening. The second air jet nozzle improves the reliability of the opening process by striking a surface of the flexible bag to overcome the continuous flow. Impinging the bag in this manner tends to remove any wrinkles at the opening, so that when the second jet is terminated the continuous flow fully opens the bag. Preferably, the second air jet flow is ionized, thereby neutralizing any static charge that is stored by the bag. Typically, the first and second air jet flows do not overlap in time.

18 Claims, 5 Drawing Sheets

DISK LOADER HAVING A SIDE AIR BLAST FOR PROPER BAG PRESENTATION

TECHNICAL FIELD

The present invention relates generally to methods and devices for automated handling of disks and more particularly to manipulation of flexible bags for packaging computer disks.

BACKGROUND ART

Often in the purchase of computer software, such as a word processing program, the software is contained on a multi-disk set of prerecorded magnetic disks. The magnetic disks are commonly referred to as floppy disks.

Each disk of a multi-disk set contains a portion of the computer program. Each portion is prerecorded separately, so that it is necessary to collate the disks in order to form a complete set. U.S. Pat. No. 5,370,495 to Montalvo et al. describes a disk-collating apparatus. Stacks of disks are placed in hoppers, with each hopper supporting a different disk in the multi-disk set. For example, in a six-disk set, the six different disks are separately prerecorded and then the six stacks are placed in six hoppers. The collating apparatus releases a single disk from each stack onto a conveyor belt, which moves the six disks uniformly toward an off-loading device.

The off-loading device at the end of the collating apparatus of Montalvo et al. is illustrated as being a stacker. Each disk from the conveyor belt slides along a tray and is inserted below a collated stack of disks. The collated stack may then be removed from the stacker and separated into a number of complete sets for packaging and sale.

The packaging may be performed by hand, but preferably the process is automated. Each set may be loaded into a plastic bag which is then sealed. An automated packaging device may be an add-on feature to the collating and stacking system of Montalvo et al., or may replace the stacker of the Montalvo et al. system. Alternatively, the automated packaging device may be completely independent of any collating system.

One concern in the operation of a disk-packaging device involves the reliability of bag opening. That is, it is important that the bags are opened sufficiently to ensure that the sets are reliably loaded. A bag that is not properly opened may result in the shipment of a short-set or in the need to temporarily shut down the automated system in order to correct any problems caused by the improper loading of disks.

Automated devices for manipulating a bag in a manner to present the bag for the loading of computer disks are known. In one such device, a short high-velocity air flow is directed into the bag to initiate the opening of the bag. A blower is then used to provide a more gentle flow of air which is designed to maintain the bag in a fully opened condition. One such device is sold by Automated Packaging Systems, Inc., which is the assignee of U.S. Pat. No. 3,948,015 to Lerner. The Lerner patent is primarily concerned with loading of powdery material, so that it describes substituting the blower with a funnel-shaped loading chute.

The process in which a brief high-velocity air flow is combined with a continuous lower velocity air flow to provide the desired bag presentation is a process that provides acceptable results. However, a goal is to increase reliability. There are occasions in which the blower is unable to complete the bag opening that was started by the high-velocity air flow.

It is an object of the invention to increase the reliability of methods and devices for the automated loading of disks, particularly computer disks.

SUMMARY OF THE INVENTION

The above object has been met by introducing a blast of air that at least partially closes a flexible bag after the bag has been either partially or fully opened. The blast of air is aimed to strike the bag in a manner that ideally smoothes the edge of a bag opening, so that when the bag is reopened the edge remains wrinkle-free. In the preferred embodiment, the air is ionized, thereby neutralizing any electrostatic charge of the bag. Since edge wrinkles and electrostatic force are two sources of difficulty in reliably presenting a bag for disk loading, the blast of air increases the reliability of an automated packaging system.

While not critical, the preferred embodiment is one in which a first blast of air is directed at an opening of the bag. The bag may be a lead bag of a web of pre-perforated polyethylene members. Easy-open bags, sometimes referred to as "go bags," are recommended .

The first blast of air is a jet flow at the opening of the lead bag in the web. A continuous flow of air from a fan or the like is directed into the opening to fully open the flexible bag. However, for various reasons, it is possible that the bag will not open fully. The present invention provides a second burst of air that provides a counter force to the pneumatic force provided by the fan. Upon termination of the second burst, the fan reopens the flexible bag, with an increased chance that the opening will have the desired shape for loading the disk.

In the preferred embodiment, the flexible bag is held in an upright position, but this is not critical. The first burst of air is downwardly directed into the opening of the bag, while the second burst is directed at an upward angle to strike the center region of the bag. The fan operates continuously. In the preferred embodiment, the first burst is completed before the second side-directed burst is initiated. If the bag is in an upright position, an acceptable angle for directing the second burst is an angle within the range of 45 degrees to 60 degrees relative to the perpendicular of the flexible bag.

An advantage of the invention is that downtime of a disk packaging system is reduced, since there is a decreased susceptibility of the system to jams that result from improper disk loading. Another advantage is that the likelihood of packaging and shipping a short-set is reduced.

BEST MODE FOR CARRYING OUT THE INVENTION

Figure 1:
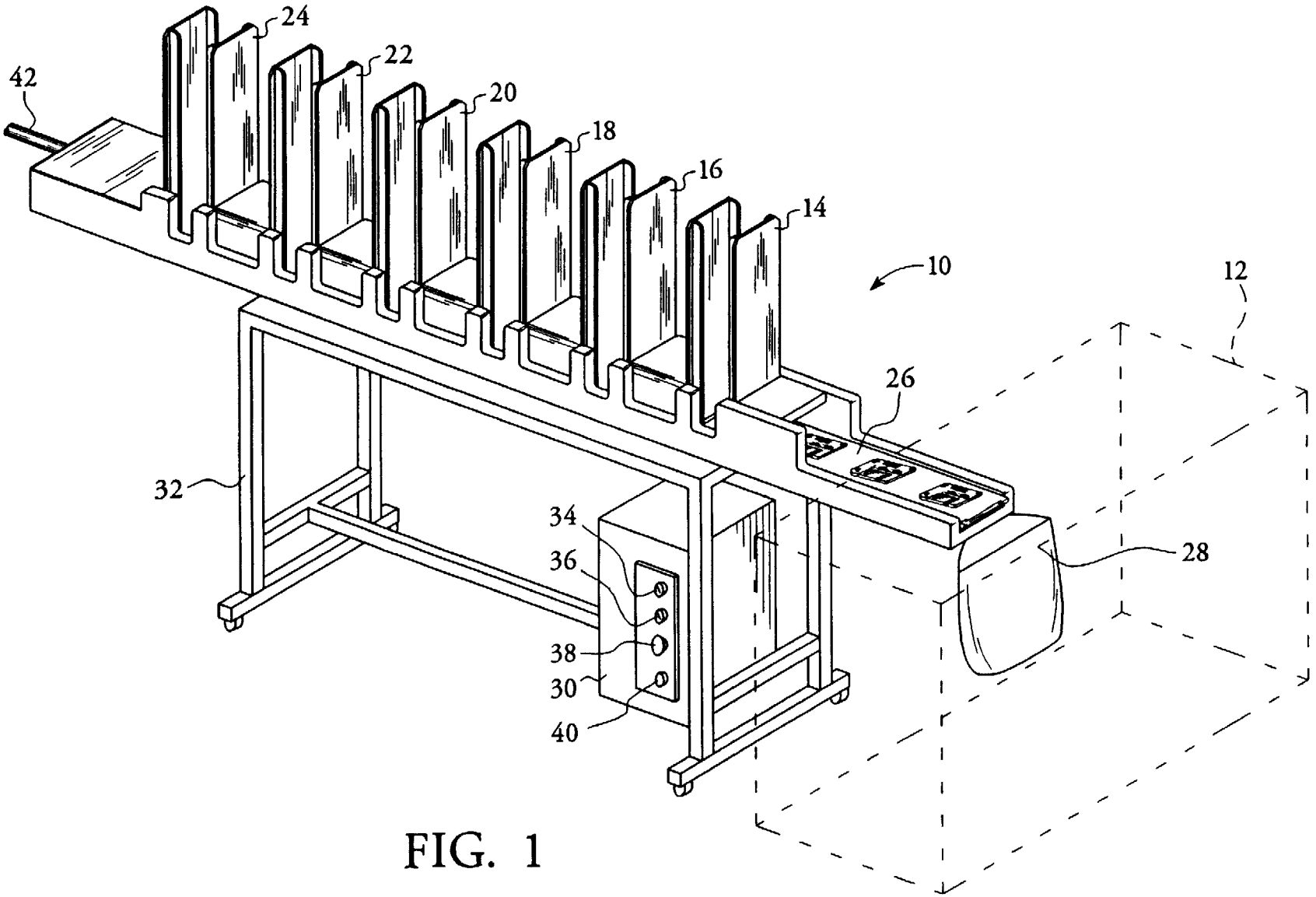
FIG. 1 is a perspective view of a disk collating apparatus for use with the loading device of the present invention.

With reference to FIG. 1, a collating apparatus 10 is shown adjacent to an automated bagger 12. The collating apparatus includes six hoppers 14, 16, 18, 20, 22 and 24. Each hopper is configured to contain a stack of disks, such as 3.5-inch floppy disks. All of the disks within a particular hopper are identical, but information on the disks of one stack will be different than information contained on disks in another stack. For example, the stacks may be six different disks of a word processing program.

The collating apparatus 10 is described fully in U.S. Pat. No. 5,370,495 to Montalvo et al. The first disk of a complete set is contained within the first hopper 14, while the last disk is contained within the sixth hopper 24. For sets less than six, no special setup is necessary, other than to identify the appropriate number at a disk counter. If instead the set is greater than six, a second collating apparatus, not shown, can be connected to the one shown in FIG. 1.

The collating apparatus 10 includes an endless conveyor belt 26 that carries individual floppy disks in the direction of the automated bagger 12. A flexible bag 28 is shown as being positioned to receive gravity-fed floppy disks from the conveyor belt. The flexible bag may be a polyethylene member having opposed first and second sides. Standard-duty polyethylene having a thickness of 0.002 inch may be used. Preferably, the bag 28 is the lead bag of a web of bags having an easy open vertical perforation. Such bags are referred to as "go bags." However, other flexible bags may be substituted.

Operation of the collating apparatus 10 is electronically controlled at a housing 30 that is fixed to a support frame 32. The housing includes controls 34, 36, 38 and 40 that may include a power switch, a control for a disk count, a start button, and/or a potentiometer for controlling the speed of the conveyor belt 26. A disk count is achieved by use of an infrared detector system, not shown. The system includes a light source that directs a beam for detecting the passage of a computer disk along the conveyor belt.

In operation, a plunger 42 is moved forwardly to remove a lowermost disk from each hopper 14–24. The disks that are removed from the hoppers drop onto the conveyor belt 26 and move forwardly for loading into the flexible bag 28 that is supported by the automated bagger 12. After the disks are loaded into the bag, the container may optionally be sealed. The flexible bag is removed and replaced with a second bag that receives a second complete set of disks.

Figure 2:
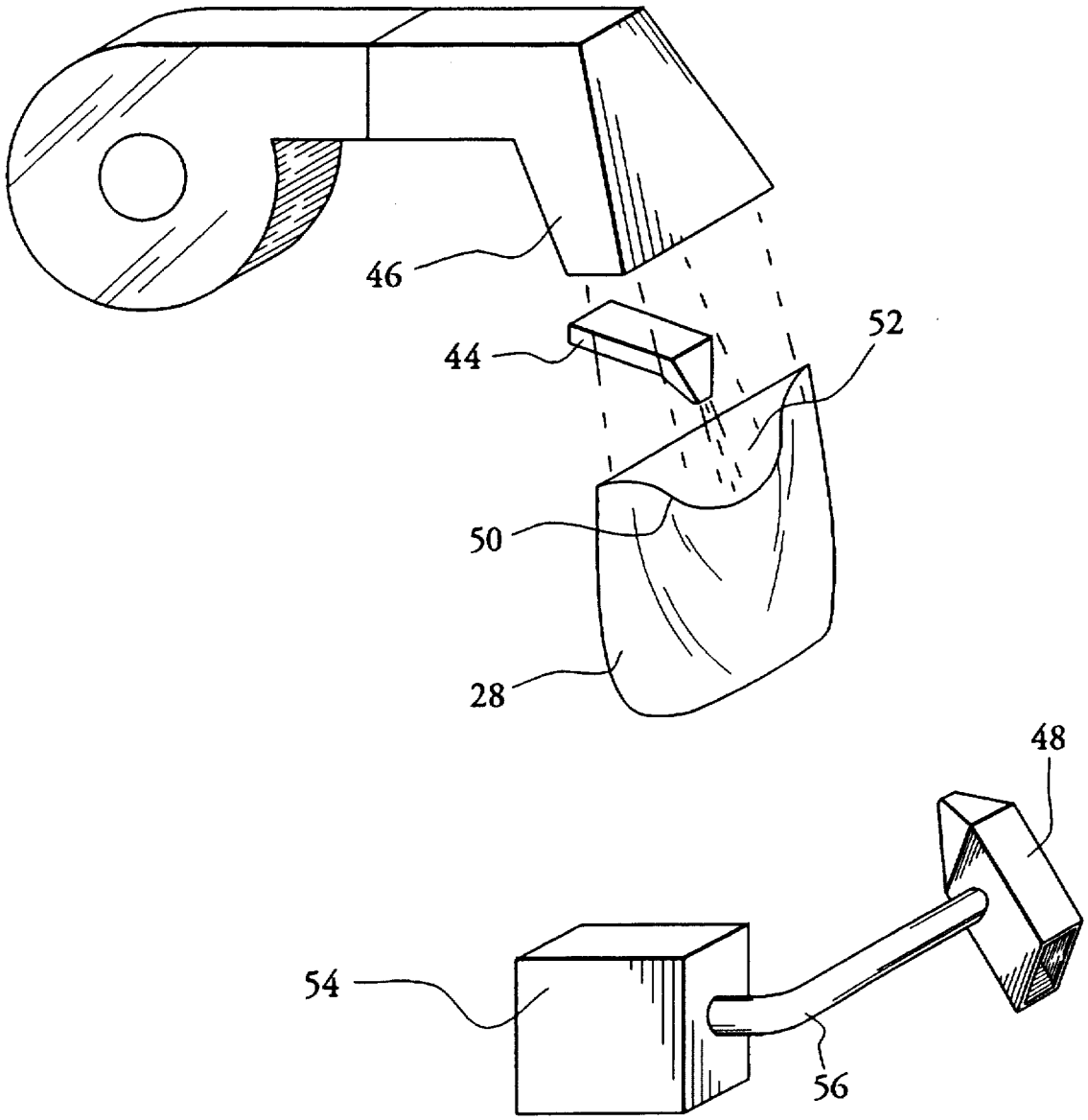
FIG. 2 is a perspective representation of three sources of air pressure in accordance with the invention.

Referring now to FIG. 2, pneumatic devices for ensuring proper presentation of the flexible bag 28 are shown as including a bag-opening nozzle 44, a fan 46, and a side-blast nozzle 48. The bag-opening nozzle 44 and the fan 46 may be connected to the automated bagger 12 of FIG. 1, while the side-blast nozzle may be connected to the collating apparatus 10. Alternatively, both of the nozzles and the fan may be joined to a single structure, since use of the present invention does not require either of the automated devices of FIG. 1.

Operation of the bag-opening nozzle 44 and the fan 46 is known in the art. The bag-opening nozzle 44 directs a jet of air downwardly at a top opening of the bag to space apart a forward side 50 from a rearward side 52 of the bag 28. After the opening has been created, continuous air flow from the fan is designed to fully open the bag. Air flow in the range of 4 to 5 CFM is acceptable.

A concern in the industry is that occasionally a bag will not fully open. Wrinkles along the rim of the forward side 50 may cause the sides of the rim to remain in contact with the rearward side 52 of the bag. Electrostatic charge of the bag 28 may also play a role in improper presentation of the flexible bag for receiving disks. Moreover, there are other sources of improper bag opening.

The orientation of the side-blast nozzle 48 relative to the flexible bag 28 is designed to improve the reliability of bag presentation. As will be explained more fully below, the side-blast nozzle 48 directs a jet of air at the forward side 50 of the bag in order to remove any tension at the rim that defines the bag opening. Thus, when the air flow from the nozzle 48 is terminated, the continuous flow of air from the fan 46 reopens the bag to achieve a desired configuration of the opening. For a bag of the type shown in FIG. 2, a preferred configuration for the opening is typically one in which the rim of the forward side 50 has a uniform radius of curvature along its entire length.

Figure 3:
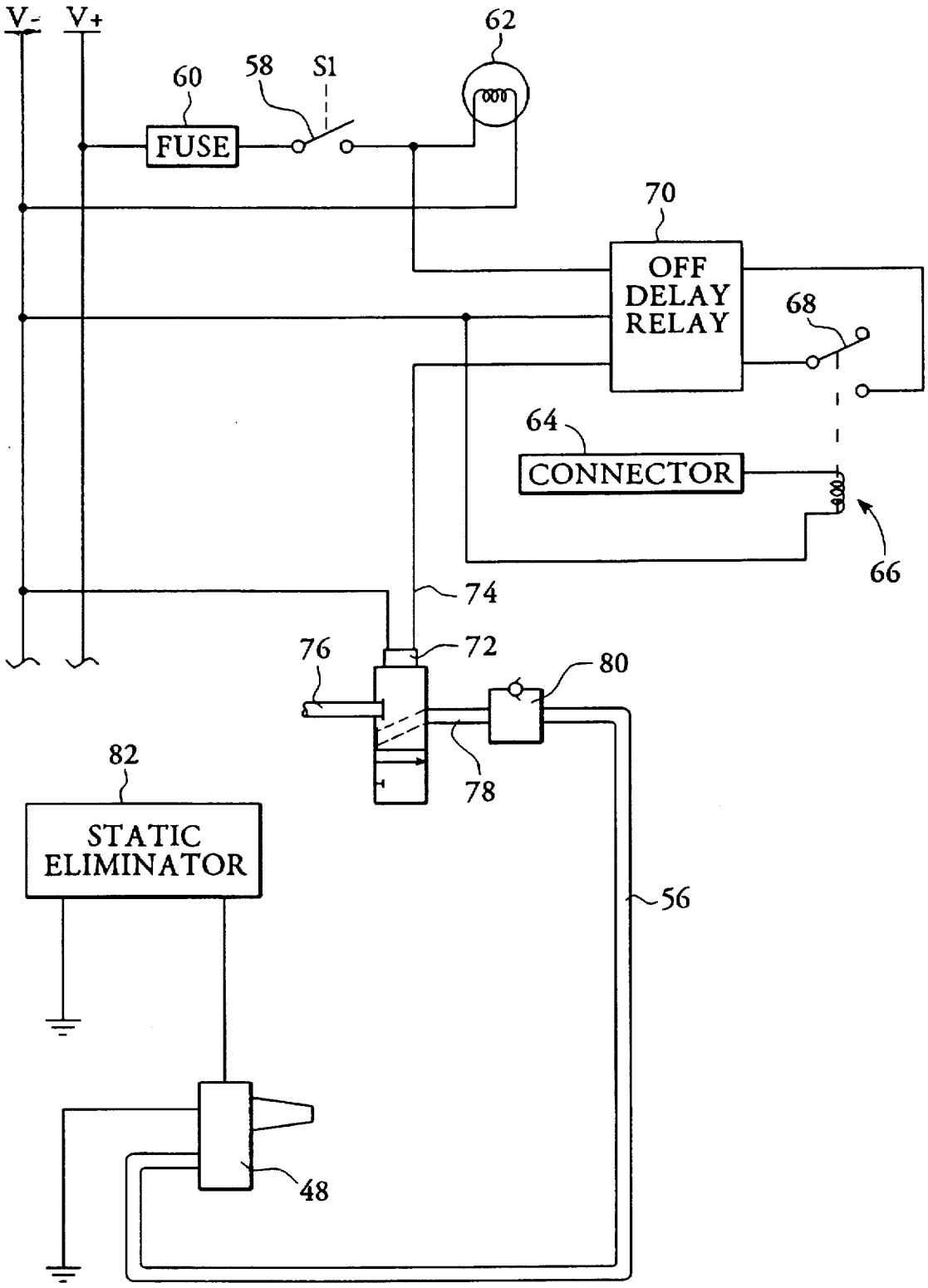
FIG. 3 is a schematic representation of operation of a side-directed blast of air in accordance with the invention.

The electrical and pneumatic flow paths for operation of the side-blast nozzle 48 are shown in FIG. 3. The control devices may be contained in a housing 54 that is connected to the nozzle by a pneumatic line 56.

The control circuitry for the side-blast nozzle 48 may be activated or deactivated at a power switch 58 that is connected to a fuse 60. A lamp 62 is optionally included as an indicator of a "power on" condition. In FIG. 1, the pneumatic source to the bag-opening nozzle 44 is controlled by an electrical pulse. This same pulse may be channeled to the circuitry of FIG. 3 via a connector 64. The pulse is channeled through a coil 66 of a relay to electromagnetically switch a contact 68 of the relay. The contact 68, when switched, initiates an "off delay" relay 70. The off delay relay is a timer that is used to establish the length of the pulse to an electrically controlled air valve 72. For example, if the desired length of air flow from the nozzle 48 is 0.2 seconds, but a single pulse at the connector 64 triggers the contact 68 for only 0.1 seconds, the "off delay" relay may be used to increase the length of each "on" pulse along an electrical line 74 from the relay 70 to the air valve 72.

The electrically controlled air valve 72 has the pneumatic line 76 to a source of air, not shown. A pulse along the electrical line 74 connects the input pneumatic line 76 to an output line 78. The output line is connected to an air timer 80 that functions as an "on delay." Typically, the side-blast of air from the nozzle 48 occurs only after completion of air flow from the bag-opening nozzle 44 of FIG. 2. The air timer 80 delays the time of action by the side-blast nozzle 48 to prevent simultaneous blasts by the two nozzles. However, if an overlap of the two blasts is preferred in a particular application, the air timer 80 may be set accordingly, or may be eliminated.

Also shown in FIG. 3 is a static eliminator 82. The static eliminator establishes a high voltage at the side-blast nozzle 48 in order to neutralize any static charge accumulated by the flexible bag 28. An acceptable embodiment is one in which the static eliminator provides a high voltage of approximately 7.5 KV, thereby providing an ionized flow from the nozzle 48.

As noted with reference to FIG. 2, the jet of air from the nozzle 44 initiates the opening process. The continuous flow from the fan 46 ideally fully opens the bag so that the rim of the forward side 50 has a generally constant radius of curvature. However, the combination of the air flows from the nozzle 44 and the fan 46 does not provide sufficient reliability in bag opening.

Figure 4:
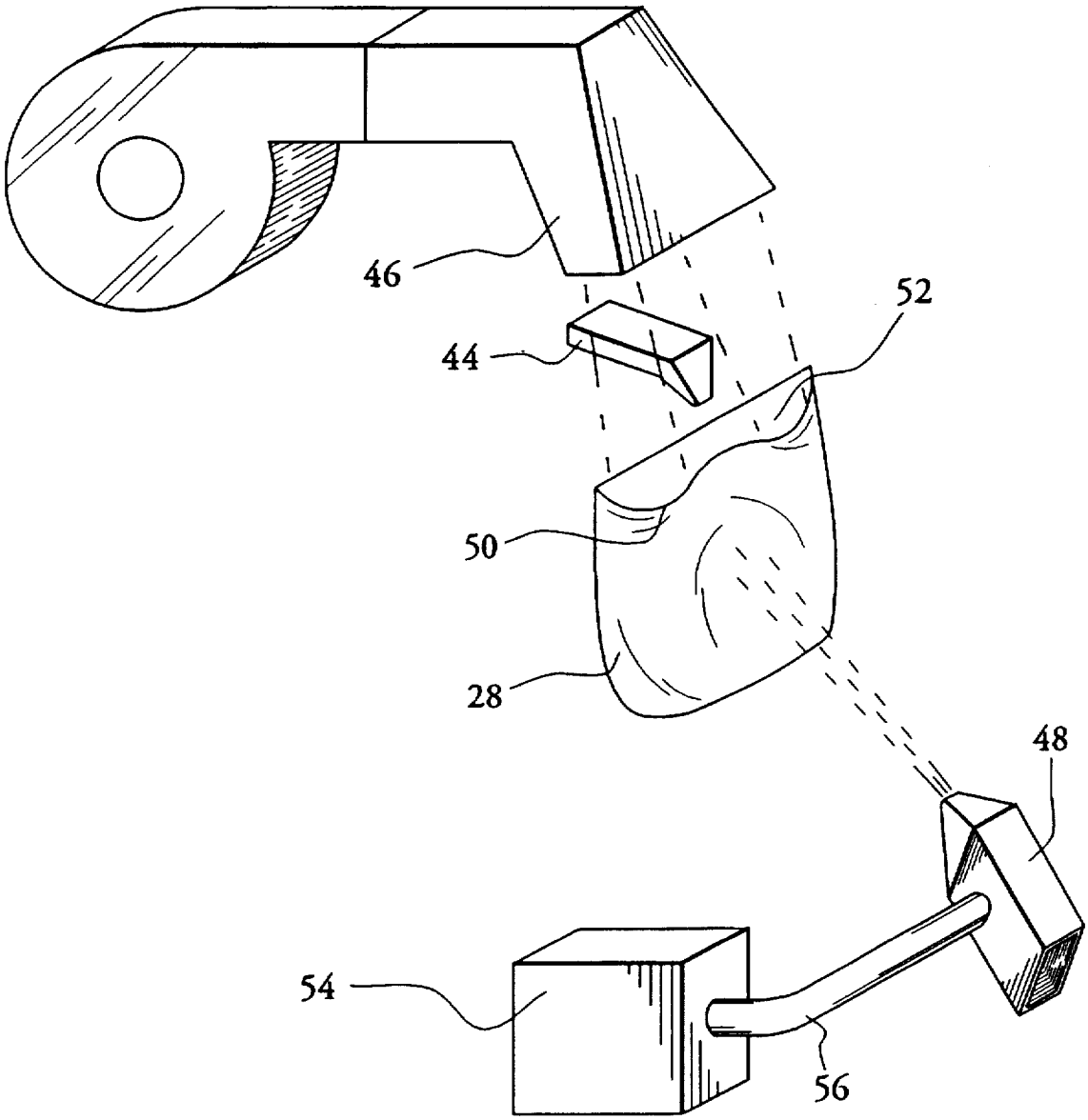
FIG. 4 is a perspective representation of the side-directed blast.

In FIG. 4, the previously described control circuitry has initiated an air blast from the upwardly directed nozzle 48. If the flexible bag 28 is in an upright position, a preferred angle for impinging the forward surface 50 of the bag is an angle in the range of 45 degrees to 60 degrees to the horizontal. However, in some applications the angle may be outside of this range. An acceptable pressure from the air jet is 70 to 80 psi, which may continue for a period of 0.2 seconds.

Figure 5:
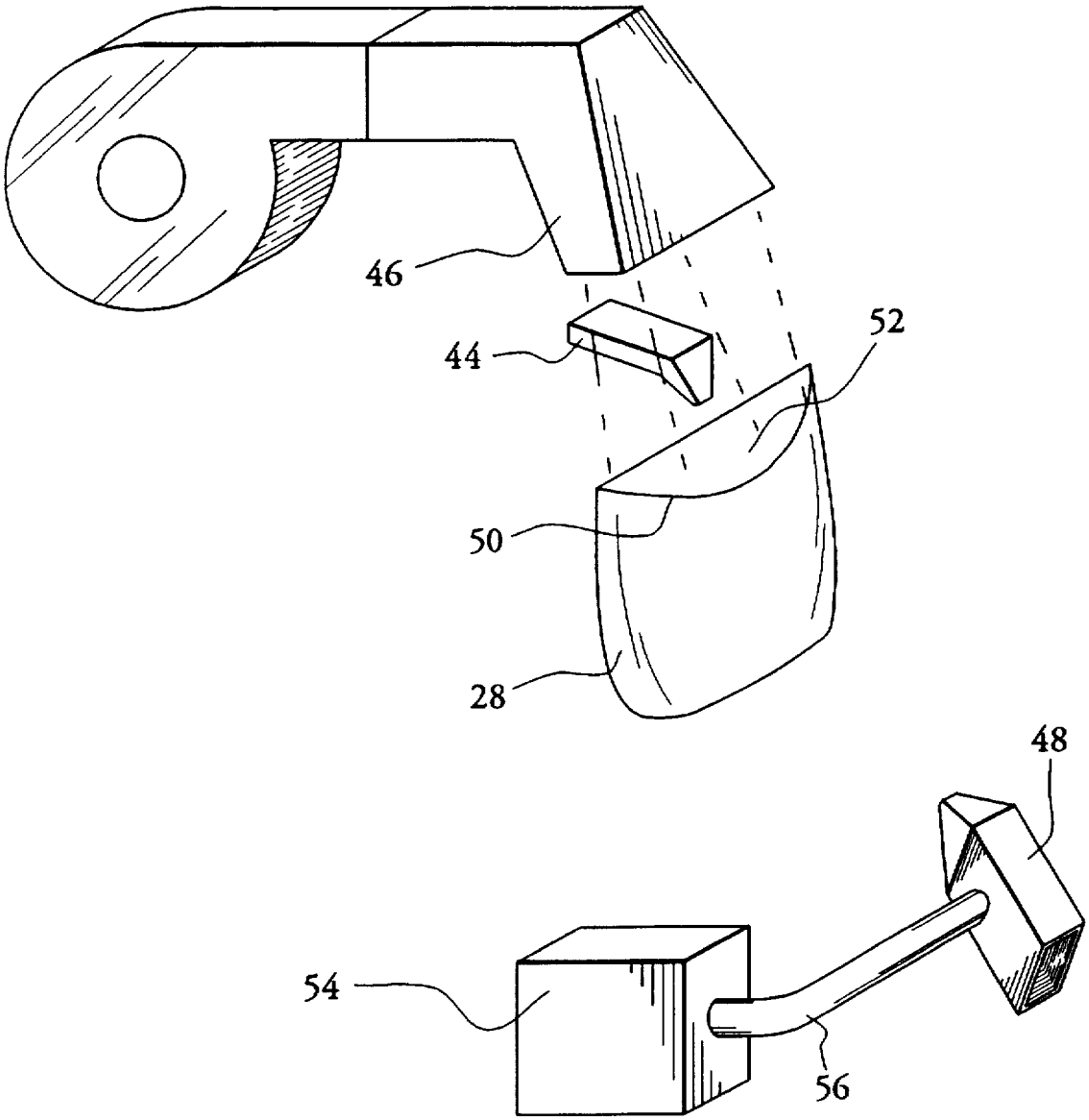
FIG. 5 is a perspective representation of the flexible bag of FIG. 2 shown in a fully-opened condition for loading disks.

As seen in FIG. 4, the jet of air from the side-blast nozzle 48 at least partially overcomes the force of the continuous air flow from the fan 46. Thus, the forward surface 50 is pushed in the direction of the rearward surface 52 of the flexible bag 28. The air pressure may be localized to the central region of the forward side 50 of the bag, so that the bag is pressed closed at its center, but opens more fully along the left and right edges of the bag. This removes any wrinkles at the lateral edges, so that the bag opens fully upon termination of the jet of air from the nozzle 48. Referring now to FIG. 5, the rim of the forward surface 50 is shown as having a generally constant radius of curvature. If this bag-presentation configuration is not desirable in a particular application, the side-blast nozzle 48 may be reoriented to improve the reliability of achieving the desired configuration. In some applications, the bag may have four panels, so that the rim of the front panel is ideally linear when the bag is fully open. For such bags, the position of the nozzle 48 may be adjusted if the adjustment would lead to improved performance of the automated packaging system.

While the invention has been described and illustrated as being used with a packaging system for a multi-disk set, the invention may also be used for packaging a single disk in each flexible bag.

I claim:

1. A method of loading disks in a flexible bag comprising the steps of:

directing a continuous flow of air into an opening of said flexible bag such that a pocket between opposed first and second sides of said flexible bag is at least partially exposed;

striking an exterior surface of said first side of said flexible bag with a blast of gas such that said first side is pressed toward said second side;

terminating said blast, thereby allowing said continuous flow of air to reshape said opening such that said pocket is exposed; and inserting disks into said pocket of said flexible bag.

2. The method of claim 1 further comprising a step of directing a first blast of gas into said opening of said flexible bag prior to said step of striking said exterior surface.

3. The method of claim 1 wherein said step of striking said exterior surface is a step of directing ionized air.

4. The method of claim 1 wherein said step of striking said exterior surface is a step of directing pressurized air at an angle in the range of 45 degrees to 60 degrees to the perpendicular of said flexible bag.

5. The method of claim 2 wherein said step of directing said first blast of gas is completed prior to initiating said step of striking said exterior surface.

6. The method of claim 1 further comprising a step of supporting said flexible bag in a generally upright condition with said opening at the upper portion of said flexible bag, said step of striking said exterior surface being a step in which said blast of gas is directed upwardly at said first side.

7. The method of claim 6 wherein said step of striking said exterior surface with said upwardly directed blast of gas includes localizing said blast to impinge said flexible bag at substantially a center of said first side.

8. The method of claim 1 wherein said step of directing said continuous flow includes aiming said continuous flow to form said flexible bag to have a wrinkle-free opening and wherein said steps of striking said exterior surface and terminating said blast are carried out to increase the likelihood that said opening is wrinkle-free.

9. The method of claim 1 wherein said step of inserting disks is a step of inserting computer disks.

10. A packaging device for presenting a flexible bag in a condition for inserting disks, said flexible bag having opposed first and second sides and having an opening, said device comprising:

fan means for directing a continuous flow of air into said opening of said flexible bag for maintaining said flexible bag in a condition in which a pocket of said flexible bag is at least partially exposed;

pulse means for directing a brief blast of air at said first side of said flexible bag, said pulse means being positioned relative to said fan means to exert air pressure to press said first side into contact with said second side;

timing means connected to said pulse means for activating said pulse means for a time period encompassed by said continuous flow of air from said fan means; and a supply of disks positioned near said fan means for inserting disks into said flexible bag.

11. The device of claim 10 further comprising a voltage supply connected to said pulse means to ionize air of said blast of air.

12. The device of claim 10 further comprising a first nozzle connected to a first supply of air blasts, said first nozzle being aimed at said opening of said flexible bag, said pulse means including a second nozzle connected to a second supply of air blasts.

13. The device of claim 10 wherein said supply of disks includes an automated correlator of computer disks.

14. The device of claim 12 wherein said second nozzle is directed at a center of said flexible bag.

15. A packaging device for loading computer disks into flexible bags comprising:

a bag-opening air jet nozzle directed at a downward angle;

a fan having an air release opening directed at a downward angle, said bag-opening air jet nozzle being positioned proximate to said fan such that air flow paths defined by said fan and said bag-opening air jet nozzle are at least partially coextensive;

a bag-impinging air jet nozzle directed at an upward angle to define an air flow path that intersects said air flow paths of fan and said bag-opening air jet nozzle;

a supply of computer disks positioned for bag-loading along a disk path that is at least partially coextensive with said air flow paths of said fan and said bag-opening air jet nozzle.

16. The device of claim 15 further comprising bag-supply means for aligning an opening of a flexible bag with said air flow paths of said fan and said bag-opening jet nozzle.

17. The device of claim 15 further comprising timer means for restricting air flow from said bag-impinging air jet nozzle to time periods subsequent to air flow from said bag-opening air jet nozzle.

18. The device of claim 15 further comprising a high voltage supply connected to said bag-impinging air jet nozzle to ionize air released therefrom.

* * * * *